United States Patent [19]

Albertsson

[11] Patent Number: 4,970,978

[45] Date of Patent: Nov. 20, 1990

[54] ARRANGEMENT FOR HANDLING A SEWING MACHINE

[75] Inventor: Frank R. Albertsson, Jönköping, Sweden

[73] Assignee: Husqvarna Aktiebolag, Huskvarna, Sweden

[21] Appl. No.: 323,886

[22] Filed: Mar. 15, 1989

[30] Foreign Application Priority Data

Mar. 21, 1988 [SE] Sweden ..... 8801038

[51] Int. Cl.[5] ..... D05B 69/18

[52] U.S. Cl. ..... 112/277; 112/220; 367/95

[58] Field of Search ..... 112/277, 220, 275, 121.11; 367/95, 108; 318/16; 328/5

[56] References Cited

U.S. PATENT DOCUMENTS 3,218,530 11/1965 Momberg et al. ..... 112/220 X
3,953,770 4/1976 Hayashi ..... 112/277 X
4,281,734 8/1981 Johnston ..... 318/16 X
4,420,751 12/1983 Paganini et al. ..... 367/108 X
4,469,038 9/1984 Fujikawa ..... 112/277

FOREIGN PATENT DOCUMENTS 0061837 10/1982 European Pat. Off. .
2167587 7/1987 Japan ..... 112/277
8805092 7/1988 PCT Int'l Appl. .

*Primary Examiner*—Peter Nerbun
*Attorney, Agent, or Firm*—Pearne, Gordon, McCoy & Granger

[57] ABSTRACT

The invention comprises an arrangement for controlling a machine by means of the body movement of the operator. It is used for controlling a sewing machine intended for a handicapped person or for an operator not using the foot control. A pulse (18) consisting of a number of periods of 40 kHz sound waves are emitted from a loud-speaker (15). The sound waves are reflected by the head of the operator and a digital circuit measures the time takes the sound pulse to return to the receiver (16). The distance measured to the head of the operator is then used to proportionally control the speed of the machines motor.

9 Claims, 2 Drawing Sheets

ARRANGEMENT FOR HANDLING A SEWING MACHINE

BACKGROUND OF THE INVENTION

The present invention relates to an arrangement for handling an electrically operated machine, such as a sewing machine, by means of a position sensor which gives impulses for determining the operating conditions of the motor.

Electric machines generally have a switch or a regulating resistor for controlling the motor. In certain cases these regulating members are provided with an automatic device sensing situations or conditions. For example in a level regulator the sensor might be a float. A sensor can be based on different physical facts such as light, sound, heat or liquid. Considering a sewing machine there must, conditionally, always be an operator sitting at the machine to keep it operating due to her presence and her contacts with the machine. The operator has both her hands mostly busy guiding the working material and, therefore, simultaneous attention to a regulating member would be inconvenient. A possible way of controlling the motor is with the arrangement of a foot control, which is a common accessory of a sewing machine. It can, however, be questioned if the foot control always is the best regulating member and, in order to obtain a better freedom of choice between different methods of controlling the motor, the present invention has been created.

SUMMARY OF THE INVENTION

The purpose of the invention is to achieve an arrangement with a sensor beside the ordinary regulating members of an electric sewing machine motor. This arrangement will be based on an emitter and a receiver of ultrasound which, depending on the presence of a person at the machine, gives impulses to the control units of the motor and consequently determines its operating conditions. In principle the arrangement works in such a way that a pulse of a number of periods of high frequency sound is emitted by an emitter. The pulse is then reflected against the operator and returns to the receiver. A measuring circuit measures the time it takes the pulse to go from the emitter to the receiver and in that way, a measure of the distance between the machine and the operator is obtained. This measure of distance is in the control circuit of the arrangement, converted into a signal for controlling the speed of the motor. Moreover, the properties of the invented arrangement are more fully described in the description that follows.

BRIEF DESCRIPTION OF THE DRAWINGS

An embodiment of the arrangement according to the invention is described below with reference to the accompanying drawings, showing in FIG. 1 a vertical projection of a sewing machine with the invented arrangement, FIG. 2 a schematic wiring diagram of the present invention FIG. 3 a sketch showing the head of the operator at different distances from the machine.

DETAILED DESCRIPTION OF THE PREFERRED EMBODIMENT

In this instance an electronic sewing machine has been provided with a mircroprocessor and push buttons as control devices which allow simple setting of the machine. It has an electric motor with an electronic speed regulator controlled by a potentiometer. In a conventional type, the latter can be actuated by a foot control but also, as now, by an arrangement in the front of the sewing machine, under a cover plate 10 at the end of the sewing machine arm 11. This location of the arrangement has been chosen because the operator holds her head in front of that part of the machine when the machine is used.

Figure 3:
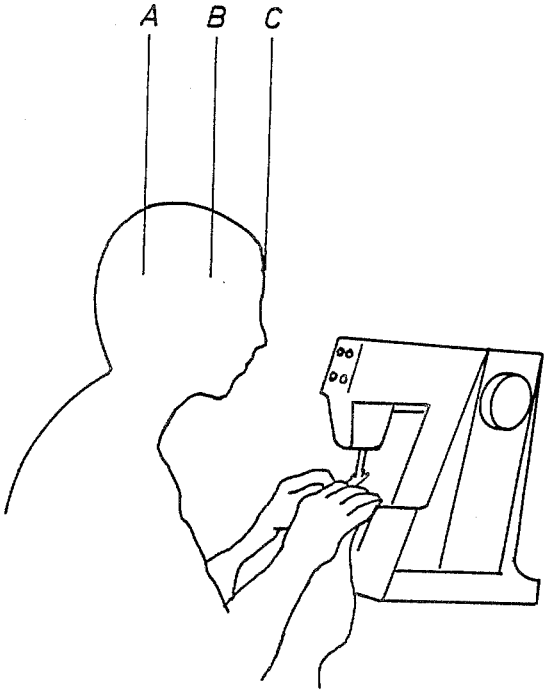

In FIG. 3 the machine is shown standing on a table with an operator sitting in front of it. The head of the operator can then be in at least three different positions relative to the machine as shown with the dashed lines A and B and the solid line C. The operator can then use a push button 12 on the plate 10, which is a so-called calibration button. In addition to the push button 13 there is an indicator lamp 13, a change over switch 14 for full and half speed, a loudspeaker 15 and a microphone 16. The latter ones can consist of so-called piezo elements.

Figure 1:
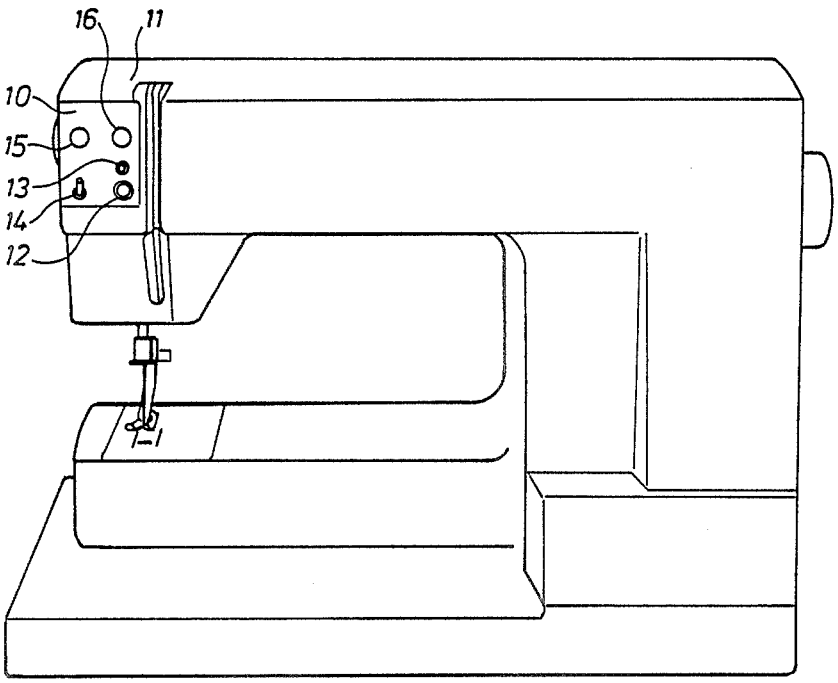
Figure 2:
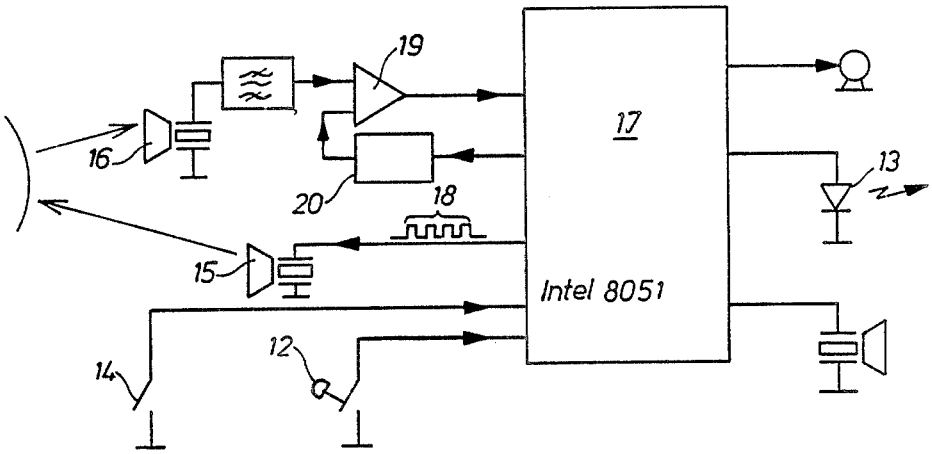

The components involved are shown in the wiring diagram FIG. 2. The central unit is a microprocessor 17 with a designation indicated on the drawing. It contains, among other things, an oscillator giving an alternating voltage with a frequency of about 40 kHz in small short pulses 18. This voltage is supplied to the loud-speaker 15 which, thus, is working above the audible frequency range and is directed towards the head of the operator. The speed of sound is about 330 m/s and the distance between the machine and the operator not more than 0.5 m. The sound pulses are reflected from the head and received by the microphone 16 where an electric signal arises from each pulse and is passed to a comparator 19. The comparator as well as a level indicator 20 have the task of separating the desired reflection pulses from the undesired direct pulse of the loud-speaker to the microphone. The signal from the reflected sound is passed to an input of the time measuring unit of the microprocessor. The time measured is the time period of the sound pulse going from the loud-speaker to the head and back to the microphone. The time measuring made in binary numbers is converted into analogue values in a digital to analogue converter. The output of this converter is a representative quantity for a speed control of the sewing machine motor. As appears from FIG. 3, the distance between the head and the machine is variable and the time period of the sound pulse depends on that distance. The speed control is effected by programming in such a way that a shorter distance results in a higher motor speed. The limits for the distances providing start and maximum speed of the motor are in FIG. 3 indicated as B and C, respectivèly.

The location A in FIG. 3 is of a special significance for the function of the arrangement and for its security. Prior to starting the work with the machine, the arrangement must be calibrated. This is carried out by means of the calibration button as mentioned above. Sitting in the upright position with the head in location A, the operator presses this button and the processor registers, in an internal memory, the distance as far as this location is concerned. At the same time the indicator lamp 13 lights as proof of this registration. Because the processor now follows a program made in advance it takes the steps as mentioned previously. Consequently, the only way to start the machine after calibration is by moving the head from A to B according to FIG. 3. During the continuous movement of the head from B to C the motor speed increases progressively to the maximum speed at C. Likewise, the speed is progressively reduced when the head moves from C to B. Head movements, if any, outside B or inside C do not lead to any other condition than that existing at B and C, respectively. Without previous calibration head movements in that area have no influence on the arrangement. If the operator wishes to move the area B-C close too or farther from the machine, a new calibration can be effected by taking a new position A and then activating the button 12.

As a supplement to the indicator 13, and for avoiding an unprepared start of the motor, the arrangement has a buzzer or the like making a sound just before the motor starts. As a further security detail the processor has a derivation circuit sensing the speed of moving objects in the area A-C. This circuit interrupts the motor operation when the speed of the object exceeds a predetermined maximum value. A condition for having the arrangement work in the intended way is that the head of the operator is moved slowly between A and C.

I claim:

1. A sewing machine with a position or movement sensor which provides impulses for determining the operating conditions of a driving motor of the machine and is arranged on the machine where it senses the presence of an operator in front of the machine, said sensor including an emitter (15) and a receiver (16) of ultrasound, said emitter being directed toward the operator, wherein a timer (17) is provided for measuring the time period it takes for ultrasound pulses to go from the sensor to the operator and back to the sensor, and a converter (17) is provided for converting the time period into impulses for operating the motor, the sensor, including the emitter, receiver and a calibrating device, being positioned as a module in the front side of the machine facing towards the operator.

2. A sewing machine according to claim 1, wherein the calibrating device (17) has an activating element (12) for determining the time period and equivalent distance between the operator and machine (A) to which the starting of the arrangement is related.

3. A sewing machine according to claim 1, wherein a derivating circuit senses changes in said time period and, when these changes exceed a predetermined maximum value or fall below a predetermined minimum value, said impulses will be cancelled at predetermined time periods.

4. A sewing machine according to claim 1, wherein said emitter is a piezoelement (15) connected to an oscillator, the output of said oscillator emitting ultrasound signals in the form of short pulses (18).

5. A sewing machine according to claim 1, wherein the receiver is a microphone connected to a comparator, said comparator having a second input connected to a level indicator.

6. A sewing machine according to claims 4 or 5, wherein the emitter and the receiver are combined in one unit.

7. A sewing machine according to claim 1, wherein a light and/or a sound indicator emit a signal when the motor starts.

8. A sewing machine according to claim 4, wherein said oscillator, time indicator, converter and calibrating device are together in one integrated circuit.

9. A sewing machine according to claim 1, wherein there is a control unit for reducing the maximum speed of the machine.

* * * * *